US006331062B1

(12) United States Patent
Sinclair

(10) Patent No.: US 6,331,062 B1
(45) Date of Patent: Dec. 18, 2001

(54) LED FLASHLIGHT

(76) Inventor: Iain Sinclair, P.O. Box 807, Hildersham, Cambridge CB1 6BX (GB)

( * ) Notice: Subject to any disclaimer, the term of this patent is extended or adjusted under 35 U.S.C. 154(b) by 0 days.

(21) Appl. No.: 09/290,556

(22) Filed: Apr. 12, 1999

(30) Foreign Application Priority Data

Apr. 8, 1998 (GB) ..... 9807768
Aug. 13, 1998 (GB) ..... 2076806

(51) Int. Cl.[7] ..... F21L 4/00; F21L 4/02
(52) U.S. Cl. ..... 362/200; 362/157; 362/184; 362/800
(58) Field of Search ..... 362/157, 200, 362/800, 184, 227; 315/200 A

(56) References Cited

U.S. PATENT DOCUMENTS 4,298,869 * 11/1981 Okuno ..... 340/782
4,423,473 * 12/1983 Kirkley ..... 362/186
4,451,871 * 5/1984 Kirkley et al. ..... 362/186
4,831,504 * 5/1989 Nishizawa et al. ..... 362/800
4,963,798 * 10/1990 McDermott ..... 362/800
5,149,190 * 9/1992 MacKenzie ..... 362/800
5,175,528 * 12/1992 Choi et al. ..... 340/331
5,313,187 * 5/1994 Choi et al. ..... 340/331
5,313,188 * 5/1994 Choi et al. ..... 340/331
5,386,351 * 1/1995 Tabor ..... 362/800
5,475,368 * 12/1995 Collins ..... 362/200
6,095,661 * 8/2000 Lebens et al. ..... 362/184

* cited by examiner

*Primary Examiner*—Sandra O'Shea
*Assistant Examiner*—David V. Hobden
(74) *Attorney, Agent, or Firm*—Price and Gess

(57) ABSTRACT

Disclosed is a portable electric light comprising a housing, a source of electrical power, and having as a light source an LED with a high internal resistance.

4 Claims, 6 Drawing Sheets

10

| V(mV) | I(mA) | L(LUX) |
|---|---|---|
| 307 | 10 | 430 |
| 330 | 20 | 745 |
| 347 | 30 | 950 |
| 360 | 40 | 1100 |
| 374 | 50 | 1210 |
| 382 | 60 | 1250 |
| 395 | 70 | 1190 |
| 403 | 80 | 1180 |
| 415 | 90 | 1130 |
| 426 | 100 | 1060 |
| 437 | 110 | 1010 |
| 448 | 120 | 945 |
| 460 | 130 | 890 |
| 474 | 140 | 810 |
| 490 | 150 | 735 |
| 505 | 160 | 655 |
| 525 | 170 | 565 |

10

| V (mV) | I (mA) | L (Lux) |
|---|---|---|
| 200 | 10 | 91 |
| 212 | 20 | 178 |
| 222 | 30 | 270 |
| 231 | 40 | 355 |
| 241 | 50 | 410 |
| 248 | 60 | 465 |
| 257 | 70 | 510 |
| 266 | 80 | 565 |
| 275 | 90 | 590 |
| 286 | 100 | 620 |
| 295 | 110 | 630 |
| 306 | 120 | 645 |
| 318 | 130 | 655 |
| 330 | 140 | 625 |
| 344 | 150 | 600 |
| 362 | 160 | 560 |
| 376 | 170 | 505 |

LED FLASHLIGHT

BACKGROUND OF THE INVENTION

1. Field of the Invention

This invention relates to a portable light, particularly to torches, flashlights and the like.

2. Description of Related Art

Light emitting diodes (LEDs) are well-known as light sources. While more efficient than incandescent light bulbs at converting electrical power to light, LEDs can generally emit only low intensity light. LEDs are widely used as indicator lights or warning lights in instrument panels (e.g., in aircraft or in road vehicles). Recently LEDs have also been used as light sources in bicycle lamps, serving to give warning to other road users of the presence of the cyclist, and in key-ring lights.

LEDs are thus generally used for "passive" illumination, in which light emitted from the LED enters an observer's eye substantially directly, so as to confer information to the observer about the LED (e.g. on or off). It is very uncommon for LEDs to be used for "active" illumination, in which light emitted from the LED encounters an object and is reflected or otherwise re-directed from the object to an observer, so as to give information to the observer about the object rather than the LED. The reason for is the low intensity of light emitted from LEDs, as explained above, and because of the delicate nature of LEDs which are easily damaged, e.g., by exposing the LED to a current and/or voltage which exceeds the maximum values stated by LED manufacturers ("overrunning") the LED. It is well known to the person skilled in the art that overrunning of LEDs should be avoided because it can cause the LED to burn out or fail, or else substantially shorten the working life of the LED.

SUMMARY OF THE INVENTION

In a first aspect, the invention provides a portable electric light comprising a housing, a source of electrical power, and having as a light source an LED with a high internal resistance (i.e., at a current of ≈50 mA an internal resistance greater than 10 Ω). Preferably the internal resistance of the LED is greater than 11 Ω, more preferably greater than 12 Ω, and most preferably greater than 13 Ω.

The inventor has surprisingly found that an LED with a high internal resistance can be overrun considerably in excess of a manufacturer's stated maximum voltage or current levels without failing and without substantially reducing the working life of the LED. An LED overrun in this way is capable of emitting far more light than is conventional, such that an electric light in accordance with the invention may usefully be employed for active illumination.

Most conventional LEDs have an internal resistance which is too low (e.g., around 9 Ω, at a current of 50 mA) to be useful for use in an electric light in accordance with the invention. However, a number of suitable LEDs are available for use in the light of the present invention. Preferably the LED is one which emits a broad spectrum of wavelengths. Conveniently, the LED emits light which is perceived by an observer as substantially white, or white with a perceptible blue tinge.

The human eye adapts so as to become more sensitive to blue light in the dark, so an electric light which emits at least some light in the blue wavelengths will be perceived by an observer as brighter than visible light of the same intensity of a longer wavelength.

A particularly preferred LED for use in the light of the invention is an LED Model No. NSPW 210AS made by Nichia, 491 Oka, Kaminaka-cho, Ana-shi, Tokushima 774 Japan.

The source of electrical power may comprise an AC input (e.g., from main supply) treated so as to be suitable for use with LEDs (e.g., voltage reduced by, for example, a step-down transformer and converted to a DC current). Preferably the source of electrical power provides a DC output ab initio. This may preferably comprise one or more dry electrochemical cells, such as a button cell or Lithium cell which are well known to those skilled in the art. Either a single cell, or a plurality of cells which may be arranged in series or in parallel, may be provided. Particularly preferred combinations are two or three button cells, used to drive one or two Nichia NSPW 310AS LEDs.

Preferably the electric light of the invention comprises a plurality of LEDs having a high internal resistance. Conveniently two or three such LEDs will be provided, which may be arranged in series, or preferably, in parallel.

Most conveniently, the electric light of the invention takes the form of a hand-held light, such as a torch or flashlight. The small size of the LED light source(s) and the selection of appropriate cells (e.g., Lithium cells) allows for a very compact arrangement which fits comfortably within the palm of a user's hand. In particular, a laterally flattened shape may be preferred, which can readily fit into a trouser or jacket pocket. Alternatively, the light may be provided with mounting means (e.g., a screw or hook), for mounting the light on a surface, such as a wall or shelf, or perhaps a spike for planting in the ground.

It is also preferred that the LED in the light of the invention has a threshold voltage which is higher than that of conventional LEDs. The threshold voltage is a term which is understood by those skilled in the art and refers to the voltage applied across an LED below which very little light is emitted. For most conventional LEDs, the threshold voltage is typically around 2 volts. In contrast, for LEDs of use in the light of the invention, the threshold voltage will preferably, but not essentially, be about 3 volts or higher.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may be best understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved flashlight with an LED source of illumination.

The inventor discovered serendipitously that certain LEDs could be overrun without becoming inoperative and without seriously reducing the working life of the LED. In order to better characterize this discovery, certain investigations were undertaken, using the NSPW 310AS LED available from Nichia, Japan.

Initial tests were performed using the LED with an electrical power source with a low series resistance, but it was found that the series internal resistance of the LED was itself sufficient to limit the current in the test circuit employed.

Illuminance Output Results

Figures 1A, 1B:
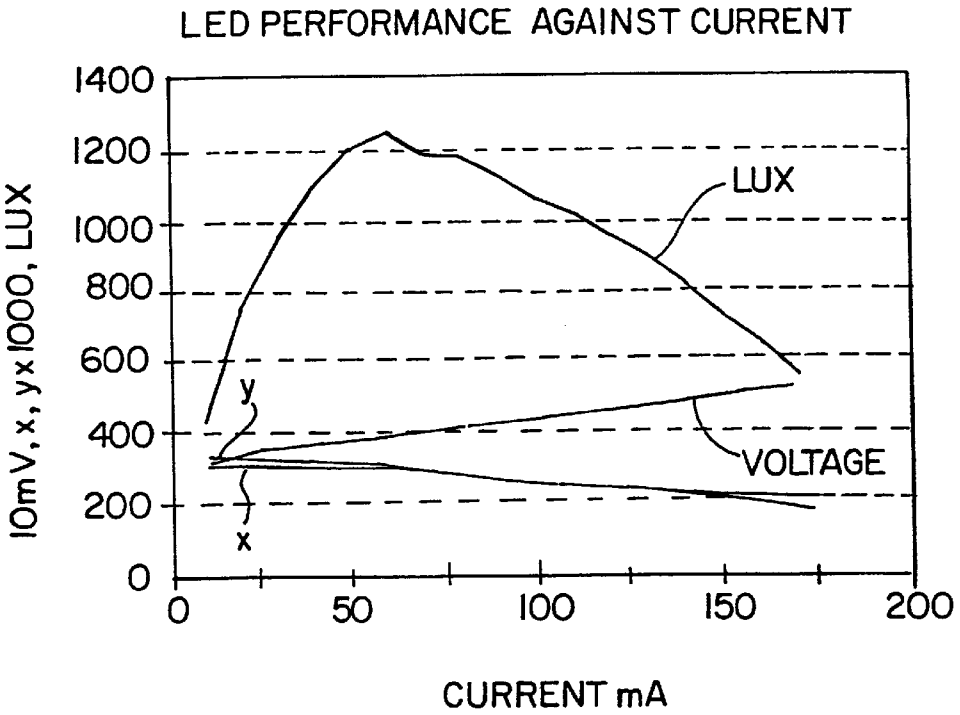
FIG. 1A is a table showing the light output (in Lux), from an LED suitable for use in a light in accordance with the present invention, at a range of values of applied voltage (in terms of millivolts) and current (mA)
FIG. 1B shows the results plotted on a graph, which also includes values for x and y, which are a measure of the colour of the light output.

The current and voltage and light levels for the Nichia LED were measured for different current values. The results are shown in FIGS. 1A, 1B. As the current is increased from about 70 mA upwards, there is a significant variation in colour. This is seen as a change in hue from a brilliant white to a light blue. The results were repeated for 3 different specimens and all gave similar results. Spacing from LED to the light meter (Minolta Lux Meter) was 25 mm.

The lighting capability is measured by its lux output (typically an illuminated working environment is 500–800 lux). This type of measurement takes account of the response of the eye to different colours.

The tests showed that the lux reading increased with current, reached a plateau and started to fall. This means that the ability to act as an illumination source for use by eye does actually become worse beyond about 75 mA. This does not mean that the total light output of the LED is falling, but rather that there is a shift towards the blue end of the spectrum, and as the eye is less sensitive at blue wavelengths the lux value will decrease.

Optical Spectra Results

Optical spectra were measured for a variety of LED currents. These show how the relative output power varies with wavelength across the whole visible spectrum. The results (data not shown) demonstrated a spike of power at the blue end of the spectrum and a broad plateau extending through to the red end. Spacing from the LED to the spectrophotometer fibre optic was 3 mm. The spectrophotometer was an Ocean Optics PC 1000-4 device.

The general trend of the graphs is an increase on relative output as the current is increased to about 70 mA, with the levels reaching a plateau and falling at higher currents. The shape of the spectrum also changes with the band between 500 nm and 600 nm being suppressed at the higher currents. This is another explanation of the blue shift as being due to a suppression of the green and red parts of the spectrum.

Figure 2:
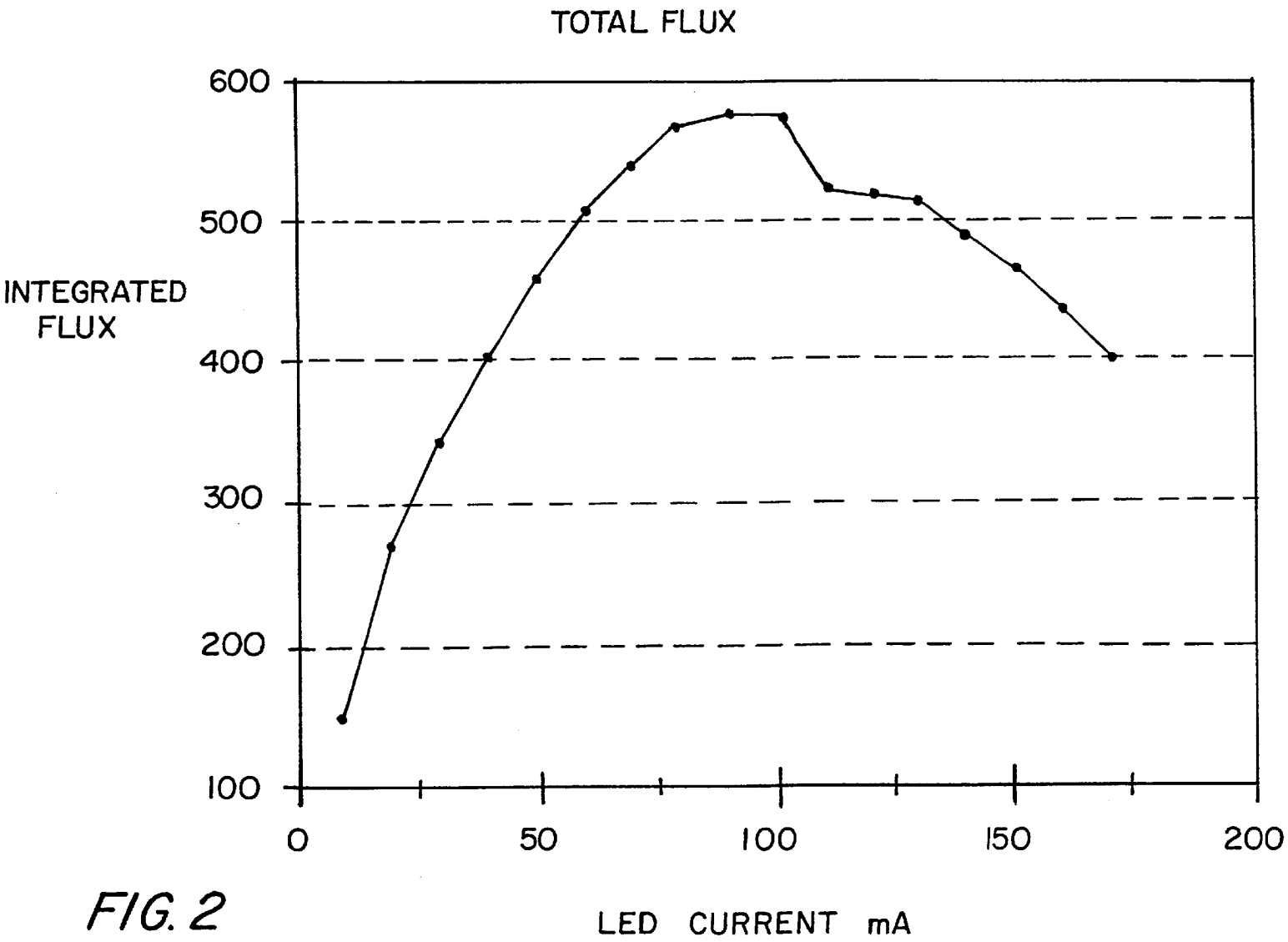
FIG. 2 is a graph of integrated flux against LED current (in mA) for the same LED.

By integrating the power at every wavelength in each of the spectra the total power being emitted can be found, as shown in FIG. 2. This also shows a peak and plateau and eventual fall off. The peak occurs at about 90 mA drive current. The reason this is slightly higher than the lux result in FIG. 1 is because the lux values take account of the peak in the eye response in the green area of the spectrum.

Figure 3:
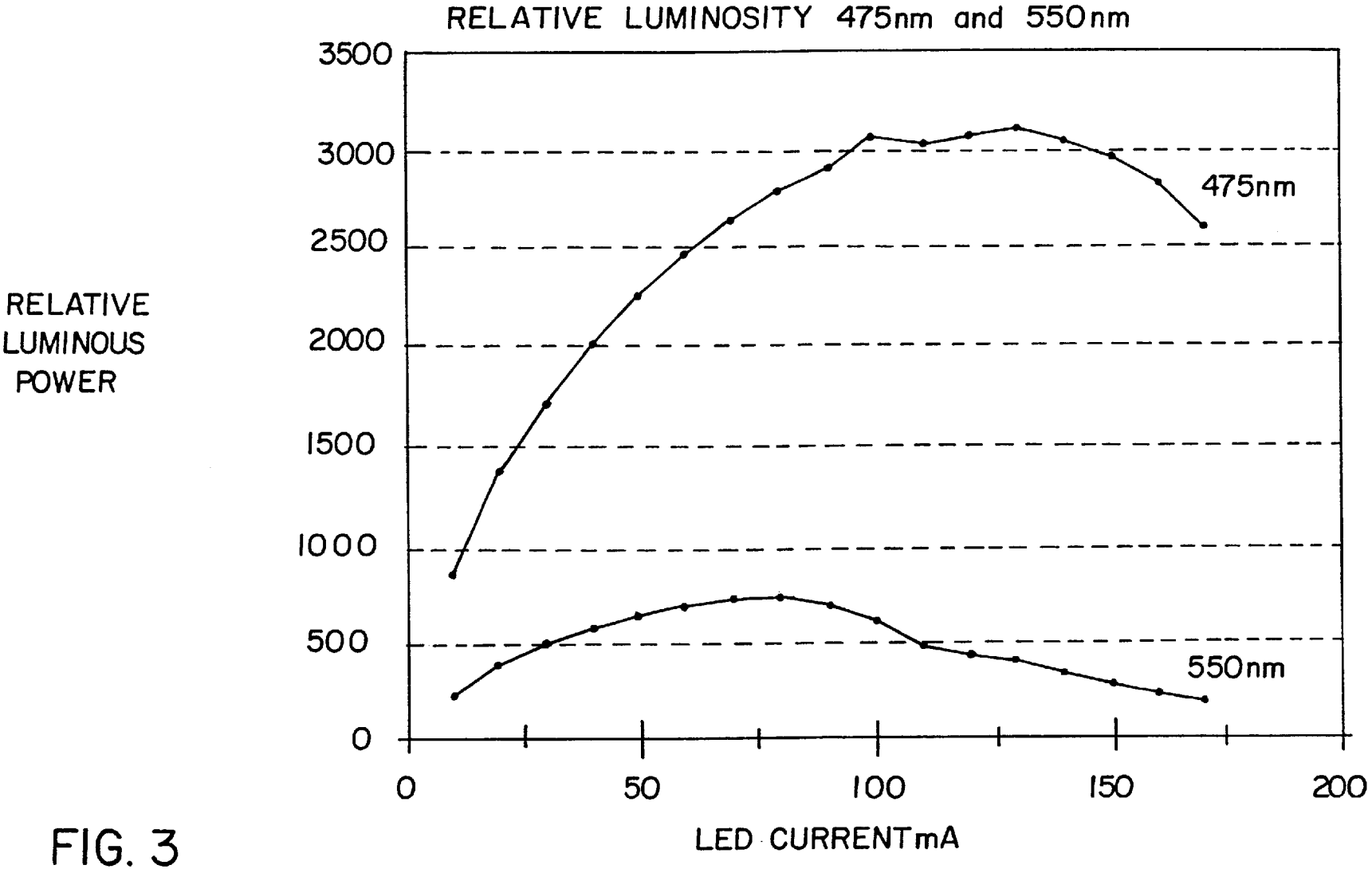
FIG. 3 is a graph of relative luminous power for light at 475 nm (top curve) and 550 nm (bottom curve) against LED current (in mA) for the same LED.

Another view of the same data can be taken by plotting the performance at a specific wavelengths across the range of drive currents. FIG. 3 shows plots for 475 nm and 550 nm. The conclusion is that the 550 nm response reaches a peak at 80 mA, while the power at 475 nm continues to increase.

Output Results with Conventional Green LED

Figures 4A, 4B:
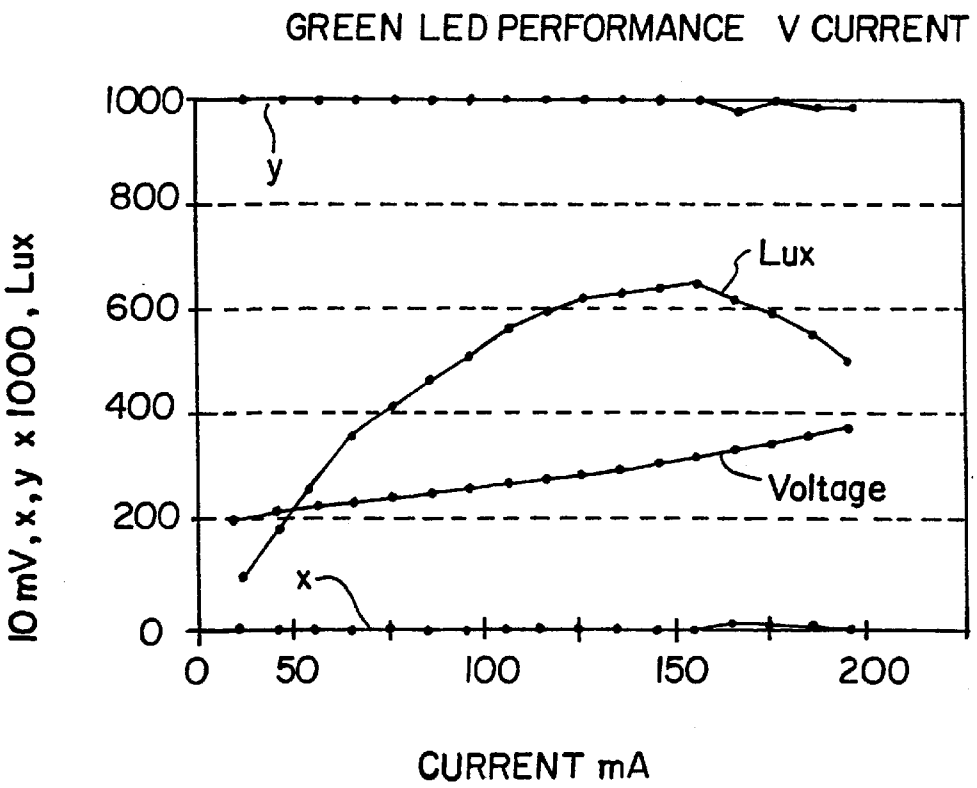
FIGS. 4A and 4B show the results of the same tests as illustrated in FIGS. 1A and 1B when conducted upon a green LED with a low internal resistance not suitable for inclusion in a light in accordance with the present invention.
Figure 5:
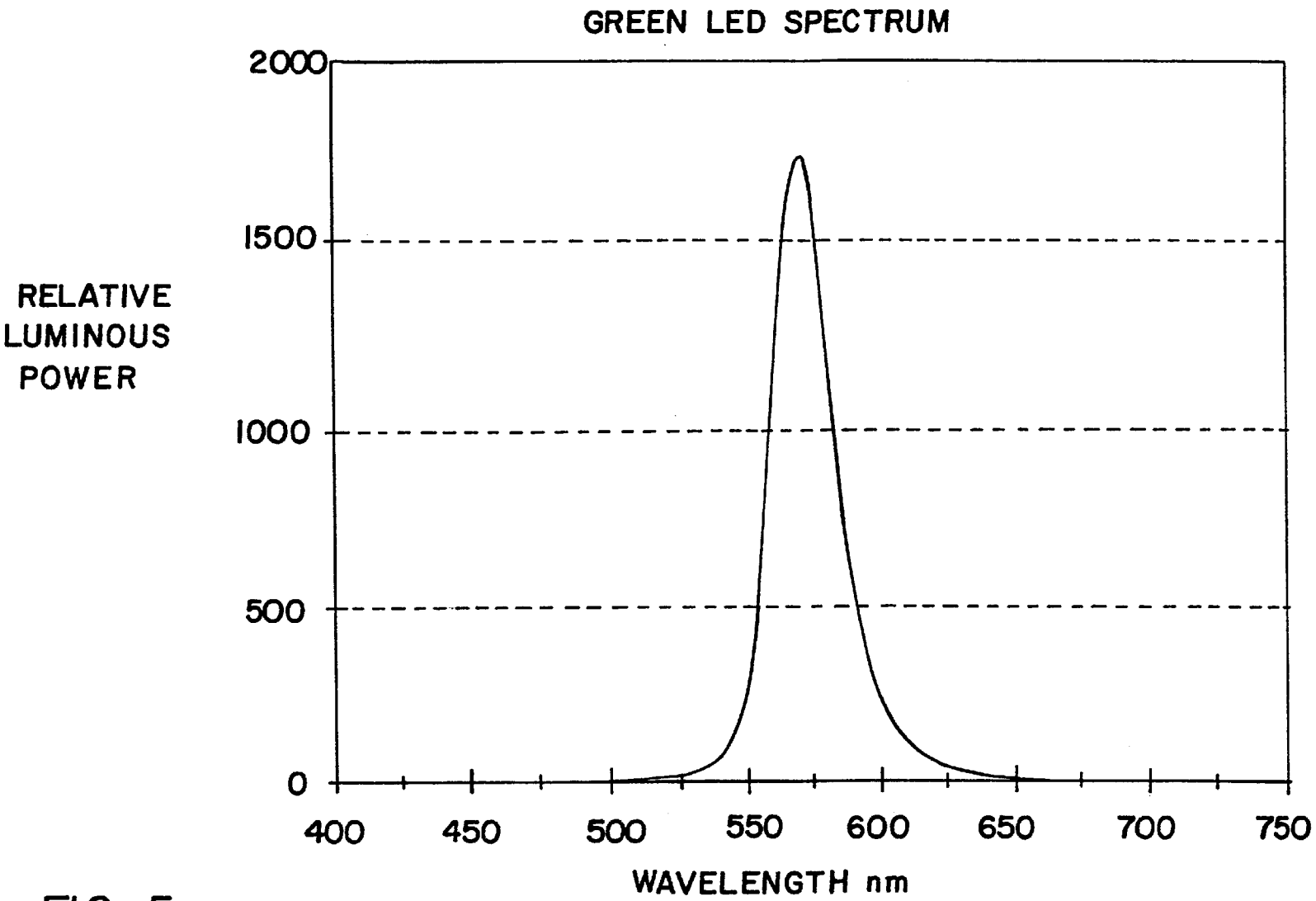
FIG. 5 is a graph of relative luminous power against wavelength (nm) for the unsuitable green LED.

A conventional green LED, with low internal resistance, was chosen for comparative tests. The same set of information was collected for the green LED as for the white LED. This showed the same general electrical performance though with a rather lower threshold voltage and slope resistance. Optically, the colour is a pure green. The Lux levels rise to a peak at about 130 mA, but the level is almost a factor of two below the white LED. The results are shown in FIGS. 4 and 5.

Lifetime Tests

The white Nichia LEDs were operated at various currents up to a maximum of 250 mA. At this point, the device started to pulse off and on almost as if a thermal trip had come into operation, though this could be simply due to a wire connection becoming unbonded at the high temperatures generated by the relatively high operating current. Further tests on a device run to this current showed that it had been damaged, with its output reduced about 50% at a test current of 70 mA.

A longer term test over 24 hour continuous operation at 100 mA was conducted. This showed that the light output both in terms of level and colour were little changed. The terminal voltage was also unaffected.

Battery Tests

All the following tests were carried out on used cells-the condition of the cells and their remaining capacity were not known.

A. Single Button Cells

These were tested open circuit and with a 100 ohm load. The results were poor, with a significant voltage drop, and no proper stabilization of output with the voltage continuing to fall quite rapidly. On removal of the load, it took nearly a minute for the open circuit voltage to recover. Test results:

| | |
|---|---|
| Open circuit voltage | 3.01 V typical |
| On load voltage | 2.55 V average after 2 seconds |

From this the effective battery series resistance can be calculated as 18 Ohm.

B. Pack of 3 Button Cells

This had a very steep fall in output voltage with load. Test results:

| | |
|---|---|
| Open circuit voltage | 8.99 V |
| On load voltage | 4.4 V after 2 seconds, 100 Ohm load |

From this the effective battery series resistance can be calculated as 104 Ohm. If this is shared between the 3 cells, then the series resistance of each would be 35 Ohm. In this case, over half the power on the battery is being lost in the battery itself.

Tests conducted with the white LED showed a current drawn of about 110 mA, but this was falling quickly.

C. Flat Lithium Cell 3V Version

| | |
|---|---|
| Open circuit voltage | 3.22 V |
| On load voltage | 3.06 V after 2 seconds, 100 Ohm load |

From this the effective battery series resistance can be calculated as 5.2 Ohm. this was a good result compared with the button cells.

Tests conducted with the white LED showed a current drawn of about 8 mA with a fall in battery voltage to 3.17V.

D. Flat Lithium Cell 6V Version

| | |
|---|---|
| Open circuit voltage | 6.36 V |
| On load voltage | 5.85 V after 2 seconds, 100 Ohm load |

From this the effective battery series resistance can be calculated as 8.7 Ohm. This was again a good result compared with the button cells.

Tests conducted with the white LED showed a current drawn of about 115 mA with a fall in battery voltage to 5.17V.

Battery Analysis

Figure 6:
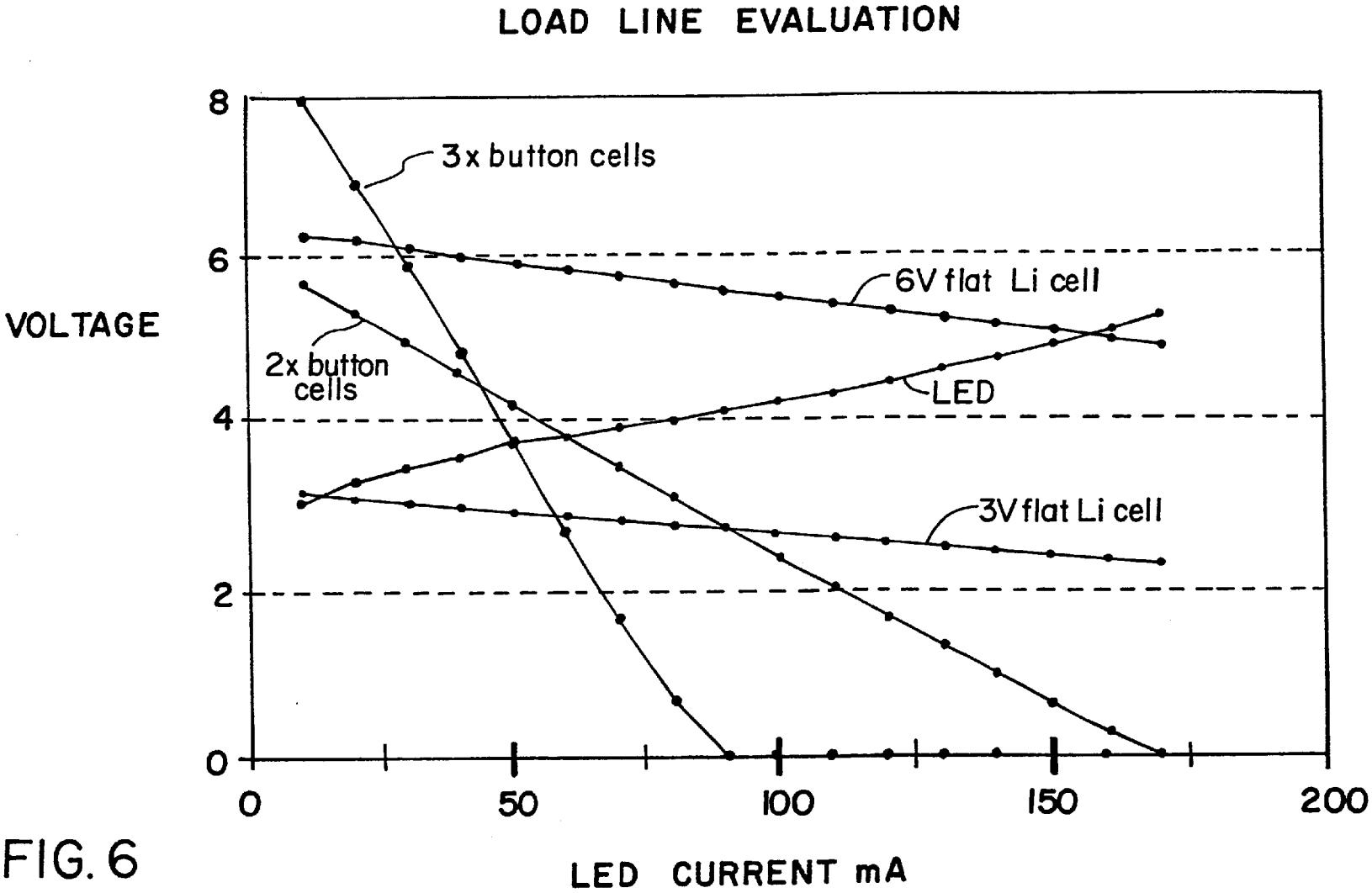
FIG. 6 is a graph of voltage against LED current (mA) for several different electrical power sources, and for a white LED suitable for inclusion in a light in accordance with the present invention.

The cell test results above can be used to evaluate the best combination of battery and LED. The method is called load line analysis and is shown in FIG. 6.

The point where any given cell output voltage crosses the LED voltage/current graph represents the operating point for that combination. The graph yields the following operating points:

| | |
|---|---|
| 2x button cells | 60 mA |
| 3x button cells | 50 mA |
| 3 V flat Lithium cell | 10 mA |
| 6 V flat Lithium cell | 150 mA |

These results are theoretically based on a resistive assumption about the output resistance of the cells. In practice, this is not true with the effective resistance increasing with increasing load current. However, the results can be used to make informed choices about how the LEDs should best be driven.

From the above results, the performance of the 3x button cells appears inferior because of the loss of power within the cell itself. The 3V Lithium cell is sub-optimal because the terminal voltage and resulting is too low and potentially also the 6V Lithium cell because it results in a current which has a light output lower than the optimum running conditions. The 2x button cell is a reasonable compromise.

Conclusions

The work leads to the following conclusions:

Although the maximum continuous current for the device is 25 mA, it was found that the device would continue to operate up to 250 mA though damage did eventually result.

Although higher currents caused an increase in total emitted power the lux output required for any illumination system for the eye shows a clear peak at about 75 mA. There is actually less useful output as the current is increased beyond this level.

The lux output result suggests that care is required in the design of a torch using the LEDs—it is possible that a series resistor may have to be included with the led (the normal way of driving the device) to ensure that the current is limited to the maximum lux level.

The device appears to be extremely robust even in the face of ten times overrun/overdrive. The long term overdrive at 100 mA showed no change in LED characteristics even though this constitutes a fourfold overdrive.

At high currents the device does get hot. The heat is conducted down the leads and any torch design should ensure that there is a route for this heat flow.

There does appear to be an optimum between the 2x button cell battery combination and its voltage and resistance characteristics, and the LED series resistance, which allows the LED to be run at, or close to, its optimum for illumination purposes.

The maximum current of operation as specified by the manufacturer needs to be de-rated as the ambient temperature increases (e.g., the maximum continuos current is set at 10 mA for an ambient of 60° C.). Although an ambient temperature of this level is unlikely, the heating effect due to the transfer of heat from the LEDs to the inside of the torch case will increase the internal temperature above ambient.

The choice of battery is important. The button cells appear to have an effective series resistance which is too high if operated as a 3-cell pack. The 3V flat cell runs rather too low a current, and its terminal voltage is too close to the threshold voltage for the LED which will give problems with dramatic light output fall with increasing ambient temperature.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An improved portable electric light including an LED with a high internal resistance, said improvement comprising overrunning the LED to achieve a maximum lux.

2. A light according to claim 1 wherein the source of electrical power provides a DC output.

3. A light according to claims 1 comprising a plurality of LEDs with a high internal resistance.

4. A light according to claim 1, wherein the LED has a threshold voltage of about 3 volts or higher.

* * * * *